United States Patent [19]

Lee et al.

[11] 4,060,463

[45] Nov. 29, 1977

[54] OPERATION OF MERCURY-CATHODE CELLS

[75] Inventors: Denis Lee; Alan David Cole Cantwell, both of Runcorn, England

[73] Assignee: Imperial Chemical Industries Limited, London, England

[21] Appl. No.: 630,688

[22] Filed: Nov. 10, 1975

[30] Foreign Application Priority Data

Nov. 19, 1974 United Kingdom ..... 50002/74

[51] Int. Cl.[2] ..... C25B 1/36; C25B 9/00

[52] U.S. Cl. ..... 204/99

[58] Field of Search ..... 204/99

[56] References Cited

U.S. PATENT DOCUMENTS

| | | | |
|---|---|---|---|
| 2,307,835 | 1/1943 | Gardner | 204/99 |
| 3,398,070 | 8/1968 | Shibata | 204/99 |
| 3,420,757 | 1/1969 | Friemel et al. | 204/99 |
| 3,630,876 | 12/1971 | Shibata et al. | 204/99 |
| 3,682,797 | 8/1972 | Carr | 204/99 |
| 3,905,880 | 9/1975 | Lee et al. | 204/99 |

*Primary Examiner*—R. L. Andrews

*Attorney, Agent, or Firm*—Cushman, Darby & Cushman

[57] ABSTRACT

A method for reducing the aqueous dispersion present in the amalgam being fed to a mercury cell which comprises reducing the velocity of amalgam stream at one or more stations along the amalgam flow where the amalgam enters a substantially static pool of amalgam which is itself covered by a layer of an aqueous phase, e.g., at lutes located at the exit of the cell, the exit of the denuder, the entry to a pump tank or pump, and the entry to a wash box feeding to the cell. The invention is advantageous for reducing chloride entrainment in the amalgam fed to the denuder and for reducing the build-up of thick mercury deposits on the baseplate of a mercury cell.

13 Claims, No Drawings

OPERATION OF MERCURY-CATHODE CELLS

The present invention relates to the operation of mercury-cathode cells for the electrolysis of alkali-metal chloride solutions. More particularly it relates to an improved method for the operation of mercury-cathode cells.

Many countries throughout the world have large installations of cells for the manufacture of chlorine and caustic alkali by the electrolysis of alkali metal chloride solution, wherein the said solution is electrolysed while flowing between the lower faces of an array of graphite or metal anode plates and a flowing liquid cathode, which is maintained by feeding in mercury or dilute alkali-metal amalgam at one end or one side of the cell and withdrawing amalgam enriched in alkali-metal at the opposite end or side of the cell. Chlorine liberated at the anodes is continuously removed from the top of the cell and the liberated alkali metal, which collects in the flowing amalgam cathode, is continuously removed in the enriched amalgam and converted to caustic alkali by reaction of the enriched amalgam with water in a soda cell, usually called a denuder, from which dilute amalgam is recirculated by means of a pump to the electrolytic cell.

In the aforesaid amalgam flow system associated with a mercury cell, the amalgam can entrain small droplets of water, aqueous caustic alkali or brine to form an aqueous dispersion of such droplets in the amalgam. Such aqueous dispersions may be present in the form of coarse dispersions or fine dispersions. It is possible that some of the aqueous dispersion originates in the denuder stage when spent amalgam is reacted with water to produce alkali metal hydroxide solution and to regenerate the mercury. However the main source of both coarse and fine aqueous dispersions is likely to be in the various lutes in the amalgam circulating system which are covered with water, brine or caustic alkali.

The coarser dispersions are also being collected and comminuted in the mercury pump. The proportion of aqueous fine dispersion in the mercury or amalgam feed can vary depending on the flow rate of amalgam, or on conditions in the denuder or the amalgam pumping tank, but it is normally up to 0.8 ppm, for example 0.2 to 0.8 ppm, by weight for that portion of the dispersion having a particle size less than 12 microns Stokes diameter. The water content of the droplets may conveniently be measured by allowing the aqueous droplets to rise to the surface of the amalgam and measuring the amount of water collecting at the surface at various time intervals.

The proportion of coarser dispersions may be up to several hundred part per million, and may vary considerably in particle size, for example up to 1000 microns. The proportion of such dispersions may be measured by determining the quantity of caustic alkali, brine or water transferred from one part of the amalgam system to another.

The entrainment of water or aqueous solution in the amalgam can lead to certain disadvantages in the operation of a mercury cell. The entrainment of aqueous alkali in the amalgam can cause a reduction in current efficiency of a chlor-alkali mercury cell and can also lead to an increase in the amount of by-product hypochlorite which is produced. The entrainment of aqueous brine in the amalgam can increase the proportion of chloride impurity in the caustic alkali produced in the denuder.

The presence of fine aqueous dispersion in the amalgam being fed to a mercury cell can also lead to the build-up of deposits of thick mercury, sometimes referred to as "mercury butter" on the baseplate of the cell. Such deposits can build up with prolonged operation of the cell and the problem has tended to become more acute with the high-current-density operation which has been practised in recent times.

Thick mercury deposits can lead to erratic reductions of the gap between the anode and the cathode amalgam, thereby necessitating, for safe operation, an increase in the inter-electrode gap setting to compensate for the gap reduction and to minimise short-circuiting.

The disadvantages associated with the entrainment of water or aqueous solution in the amalgam flow associated with a mercury cell may be avoided or mitigated by reducing the amalgam flow at particular points in the amalgam system.

According to the present invention we provide a method for reducing the aqueous dispersion present in the amalgam being fed to a mercury cell which comprises reducing the velocity of amalgam stream at one or more stations along the amalgam flow where the amalgam enters a substantially static pool of amalgam which is itself covered by a layer of an aqueous phase.

By the term "amalgam" we include very dilute solutions of alkali metal in mercury or essentially pure mercury.

In particular, the static pools of amalgam covered by aqueous phase comprise the various lutes in the amalgam flow system, for example the lutes which are located at the exit of the cell and before the denuder, at the exit of the denuder, at the entry to the pump tank or pump and at the entry to the wash boxes feeding to the cell.

The reduction in velocity of the amalgam flow which is required at the entry to such lutes to achieve an amalgam having the desired low aqueous dispersion content is dependent on the initial amalgam flow and on the slope and width of the conduit feeding the amalgam to a static pool. A suitable reduction in the entrainment of water or aqueous solution may be achieved for example, by reducing the amalgam flow velocity from 200–500 cm/min to about 40 cm/min.

The reduction in velocity of the amalgam may be conveniently achieved by immersing a multi-apertured barrier across the flow of amalgam. Barriers of various shapes, sizes and materials may be used, for example a plurality of rods mounted on the base of the amalgam conduit, but it is especially convenient to use a multi-apertured metal member which is firmly and closely fixed to the aforesaid base, for example an assembly of wire(s) or chain(s), a plurality of woven gauze or mesh pads, drilled plates or expanded metal sheets. The member may be held in position by any convenient means, for example clamps, bolts or rivets.

Suitably, the multi-apertured member is constituted in mild steel, iron or nickel, which materials are readily amalgamated but not dissolved when in use. The apertures of the member may vary in pore size along the line of flow of amalgam, if desired, for example by using a mesh of variable pore size which decreases in the direction of amalgam flow.

The invention is especially advantageous for reducing the entrainment of the aqueous phase at lutes in the amalgam flow system, for reducing the chloride entrainment in the amalgam fed to the denuder, and for reducing the build-up of thick mercury deposits on the baseplate of a mercury cell which is caused by this entrainment.

The invention is illustrated but not limited by the following Examples.

EXAMPLE 1

A flow of amalgam, 3 liter/min, was directed down a 3 cm wide chute at 45° into a static pool of amalgam. A plurality of mild steel wire mesh pads (1 inch mesh size, with strands 1–2 mm diameter) was mounted rigidly on to the chute across the flow of amalgam. From the depth of the amalgam before and after fitting the mesh, it was estimated that the amalgam flow velocity was reduced from 300 cm/min to 40 cm/min. The pool of amalgam and the lower part of the chute containing the mesh were covered with an aqueous solution of sodium chloride. The amalgam was transferred through a conduit to a second vessel containing a shallow pool of amalgam covered with water, where the entrained aqueous brine settled out. The amount of entrainment was determined by measuring the chloride content of the aqueous layer in the second vessel. The entrainment was found to be less than 3 parts by weight of water per million parts by weight of amalgam.

By way of comparison, the measurement of entrainment was carried out using a plain chute. The amount of water entrained corresponded to 150 to 500 parts by weight of water per million parts by weight of amalgam.

EXAMPLE 2

A plurality of mild steel wire mesh pads (1 inch mesh size, with strands 1–2 mm diameter) were fitted to a sloping denuder base which was the inlet to a lute filled with mild steel chain (having links made from wire mesh 2 mm diameter, 10 mm length). The arrangement of wire mesh pads and chains was such that the apertures presented to the amalgam flow were of the order of the thickness of the wire constituting the pads and chains. 60 liter/min of amalgam (containing 0.002–0.02% by weight of sodium) were passed through the lute. 1.3 kg/hour of caustic soda were entrained in the amalgam being fed to the pump tank, pump, wash box and cell.

By way of comparison, the measurement of caustic soda entrainment was carried out in the absence of wire mesh pads and chain. The amount of caustic soda entrained in the amalgam was 8.7 kg/hour.

EXAMPLE 3

Example 3 was repeated on a laboratory scale using wash water in contact with the amalgam stream instead of caustic soda liquor. 12 liter/min of amalgam were passed. The amalgam entrained 4 ppm of water when the wire mesh pads and chains were fitted. By comparison, the 140–340 ppm of water were entrained in the absence of wire mesh pads and chains.

What we claim is:

1. In a method of operating a mercury cell comprising a circulating stream of fluid amalgam which passes through the cell as a flowing cathode, a pump and denuder and which includes at least one station at which the flowing amalgam enters a substantially static pool of amalgam covered by an aqueous phase at a velocity which causes a portion of the aqueous phase becomes dispersed in the amalgam, the improvement which reduces the amount of aqueous dispersion in the amalgam, said improvement comprising reducing the velocity of the amalgam just before the amalgam enters the substantially static pool.

2. A method as claimed in claim 1 wherein the reduction in velocity of the amalgam is achieved by immersing a multi-apertured barrier across the flow of amalgam.

3. A method as claimed in claim 2 wherein the barrier comprises a metal member mounted on the base of a conduit for the amalgam.

4. A method as claimed in claim 3 wherein the metal member comprises an assembly of wire(s) or chain(s), a plurality of woven gauze or mesh pads, drilled plates or expanded metal sheets.

5. A method as claimed in claim 3 wherein the metal member is constituted in mild steel, iron or nickel.

6. A method as claimed in claim 2 wherein the barrier comprises a plurality of rods mounted on the base of a conduit for the amalgam.

7. A method as claimed in claim 1 wherein the static pool of amalgam covered by aqueous phase comprises a lute in the amalgam flow.

8. A method as claimed in claim 7 wherein the lute is located at the exit of the cell.

9. A method as claimed in claim 7 wherein the lute is located at the exit of a denuder.

10. A method as claimed in claim 7 wherein the lute is located at the entry to a pump tank or pump.

11. A method as claimed in claim 7 wherein the lute is located at the entry to a wash box feeding to the cell.

12. A method as claimed in claim 1 wherein during said velocity reduction the amalgam flow velocity is reduced from 200–500 cm/min to about 40 cm/min.

13. A process for reducing the build-up of thick mercury deposits on the baseplate of a mercury cell which comprises the step of reducing the entrainment of aqueous dispersion present in the amalgam being fed to the mercury cell in accordance with the method claimed in claim 1.

* * * * *